US006112916A

United States Patent [19]

Barnes et al.

[11] Patent Number: 6,112,916

[45] Date of Patent: Sep. 5, 2000

[54] OVEN RACK

[75] Inventors: Shelton T. Barnes, Chattanooga; Perry A. Bennett, Cleveland; Valerie L. Hern-Fonseth, Hixson, all of Tenn.

[73] Assignee: Maytag Corporation, Newton, Iowa

[21] Appl. No.: 09/379,583

[22] Filed: Aug. 24, 1999

[51] Int. Cl.[7] ..... A47F 5/00

[52] U.S. Cl. ..... 211/153; 211/134; 126/337 R; 126/339

[58] Field of Search ..... 126/337 R, 332, 126/339; 211/153, 134, 181.1

[56] References Cited

U.S. PATENT DOCUMENTS

| | | | |
|---|---|---|---|
| 366,968 | 7/1887 | McClave . | |
| 1,830,230 | 11/1931 | Gwyer . | |
| 1,925,371 | 9/1933 | Charter . | |
| 2,189,240 | 2/1940 | Borr . | |
| 2,225,991 | 12/1940 | Hobson . | |
| 2,251,799 | 8/1941 | Naoe . | |
| 2,421,922 | 6/1947 | Bocchino . | |
| 2,466,360 | 4/1949 | Bitney . | |
| 2,609,267 | 9/1952 | Hallock . | |
| 2,671,004 | 3/1954 | Chadwick et al. . | |
| 2,767,298 | 10/1956 | Fry . | |
| 2,804,068 | 8/1957 | Miller et al. . | |
| 2,806,467 | 9/1957 | Slaughter . | |
| 2,875,016 | 2/1959 | Fry . | |
| 2,879,763 | 3/1959 | Long . | |
| 3,106,202 | 10/1963 | Arduna . | |
| 3,141,590 | 7/1964 | Anderson . | |
| 3,143,638 | 8/1964 | Scott . | |
| 3,169,520 | 2/1965 | Smith et al. . | |
| 3,266,484 | 8/1966 | Carpenter et al. . | |
| 3,489,136 | 1/1970 | Bucellato . | |
| 3,550,580 | 12/1970 | Wong . | |
| 3,675,638 | 7/1972 | Baltz et al. . | |
| 3,789,826 | 2/1974 | Baltz et al. . | |
| 3,791,371 | 2/1974 | Oatley . | |
| 3,830,220 | 8/1974 | Demetreon . | |
| 3,976,000 | 8/1976 | Oxel . | |
| 3,977,389 | 8/1976 | Ondrasik, II . | |
| 4,194,495 | 3/1980 | Scherer . | |
| 4,510,362 | 4/1985 | Miller | 126/337 R X |
| 4,553,523 | 11/1985 | Stohrer | 126/337 R X |
| 4,637,373 | 1/1987 | Shirai et al. . | |
| 4,651,713 | 3/1987 | Ondrasik, II . | |
| 5,272,317 | 12/1993 | Ryu . | |
| 5,507,398 | 4/1996 | Miller . | |
| 5,638,809 | 6/1997 | Wienhold . | |

*Primary Examiner*—Robert W. Gibson, Jr.
*Attorney, Agent, or Firm*—Everett G. Diederiks, Jr.

[57] ABSTRACT

An oven rack for supporting food items to be cooked in a cavity of an appliance includes a support platform defined by a plurality of support elements that establish primary and secondary zones upon which food items to be cooked can be placed. The support elements are located in closer proximity within the primary zones than in the secondary zones. Preferably, the support elements are further interconnected by at least one cross support element in each of the primary zones. With this configuration, a consumer is directed to support food items to be cooked in optimal locations upon the oven rack.

20 Claims, 1 Drawing Sheet

OVEN RACK

BACKGROUND OF THE INVENTION

1. Field of the Invention

The present invention pertains to the art of cooking and, more specifically, to a rack configured to enhance the supporting of food items in optimal locations for cooking operations, particularly the supporting of bread or the like to be toasted in an oven.

2. Discussion of the Art

Typically, cooking appliances designed for household use are provided with one or more racks for supporting food items to be cooked within an oven cavity. The oven cavity itself is generally provided with side wall rails for supporting respective lateral sides of the rack, while permitting the rack to be vertically adjusted. That is, the rack can slide along a selected set of support rails for movement into and out of the oven cavity, with the rack also being removable for cleaning or for repositioning at a different height.

Oven racks are often of wire frame construction. More specifically, a typical oven rack would be defined by an outer wire frame and a support platform constituted by a plurality of fore-to-aft and laterally spaced wires. The wires are substantially evenly spaced across the entire rack for use in supporting food items to be cooked.

A substantial amount of effort has been placed in the past on providing uniform heating within an oven cavity. Despite these efforts, it is substantially inevitable that hot spots will be created. This situation is particularly prevalent in connection with electric cooking appliances wherein heat for a cooking operation is developed through the use of an electric heating element, such as a sheathed resistance coil type heating element. With this arrangement, radiant heat is inherently somewhat concentrated in the vicinity directly above the heating element.

Due to this fact, advantages can be obtained in positioning food items in optimal positions upon a rack. For example, it can be quite advantageous to arrange bread substantially directly above a heating element when performing a toasting operation within an oven cavity. Despite this knowledge, food items to be cooked are typically placed in a central support location upon a rack by a consumer, regardless of the particular cooking operation to be performed.

Based on the above, there exists a need in the art for an oven rack constructed in a manner which directs a consumer to place food items to be cooked in optimal locations upon the rack such that improved cooking operations, particularly toasting operations, can be performed.

SUMMARY OF THE INVENTION

In accordance with the present invention, a rack for supporting food items to be cooked in an oven cavity of an appliance is designed to have primary and secondary zones for supporting the food items. Each of the zones are defined by support elements. The support elements are located in closer proximity within the primary zones in order to direct a consumer to position the food items in the primary zones. When utilized in connection with an electric oven, the primary zones are generally arranged above portions of an electric baking element provided within the oven cavity. With this arrangement, the toasting of bread or other specific cooking operations can be performed with the food items being supported in optimal cooking locations.

In accordance with the preferred form of the invention, the rack is constructed of wire and formed with a frontal section and an aft section. The primary zones are arranged at locations spaced from sides of the racks. At least the aft section defines both primary and secondary zones, with a secondary zone being preferably interposed between first and second laterally spaced primary zones. In the primary zones, the support wires are preferably interconnected by cross wires for added structural integrity.

Additional objects, features and advantages of the present invention will become more fully apparent below from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
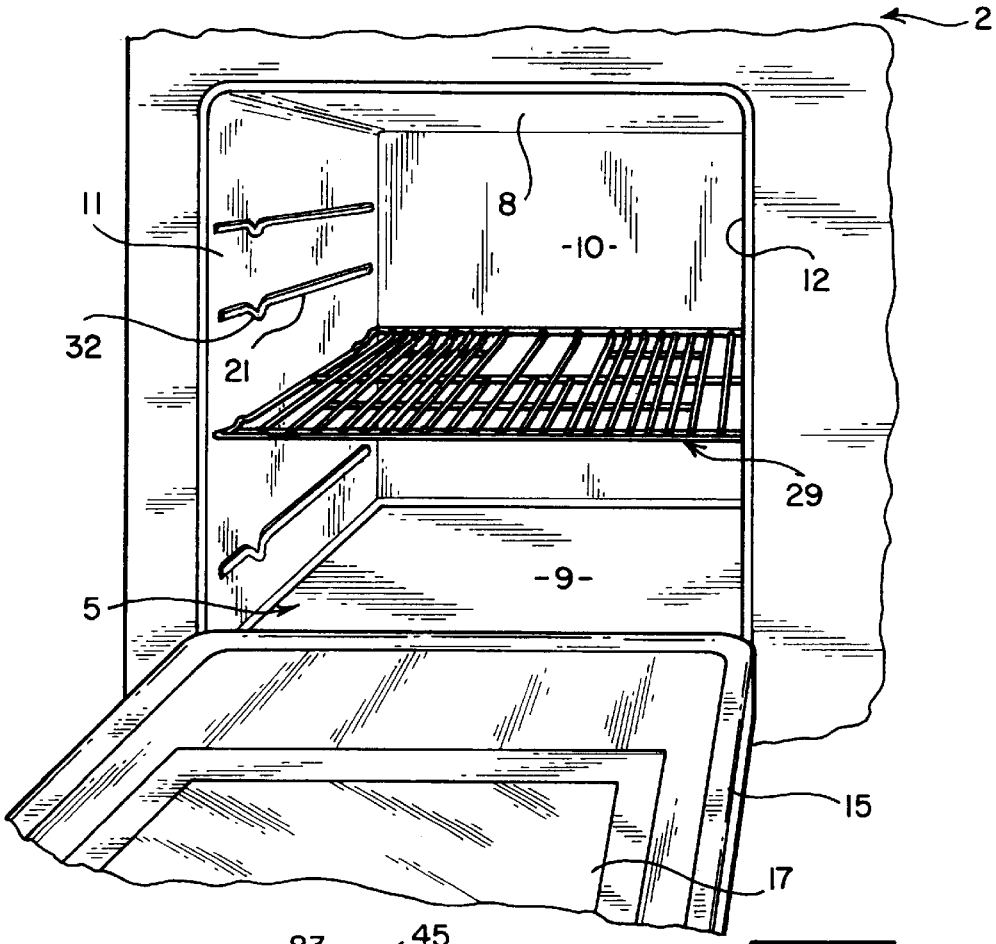
FIG. 1 is a partial perspective view of an oven cavity incorporating a rack constructed in accordance with a preferred embodiment of the invention.

With initial reference to FIG. 1, a cooking appliance 2 is generally shown to include an oven cavity 5. Oven cavity 5 is defined by top, bottom, rear and side walls 8–12 respectively. Cavity 5 is adapted to be selectively closed by means of a door 15 that is illustrated to include a tempered glass section 17. As various types of heating sources can be utilized in connection with the invention, no particular heating element is illustrated in this figure. However, as will become more fully evident below, this invention is particularly adapted to be utilized in an electric cooking appliance incorporating an electric baking element such as that disclosed in a U.S. patent application entitled "ELECTRIC HEATING ELEMENT FOR A COOKING APPLIANCE" filed on even date herewith which is assigned to the same assignee as the present case and incorporated herein by reference.

In a manner known in the art, side walls 11 and 12 are preferably provided with a plurality of fore-to-aft extending and vertically spaced rails, one of which is indicated at 21. The rails 21 are arranged as associated pairs on the side walls 11 and 12 in order to support an oven rack 29 that extends across substantially the entire width of cavity 5. With this construction, rack 29 can be supported upon any selected pair of rails 21 such that rack 29 can assume various vertical positions within cavity 5. For the sake of simplicity of the drawings, rails 21 have been indicated to be spaced a considerable distance in this figure. In practice, additional rails 21 will be provided such that the spacing between adjacent rails would only be slightly greater than the height of a rear portion of rack 29.

Figure 2:
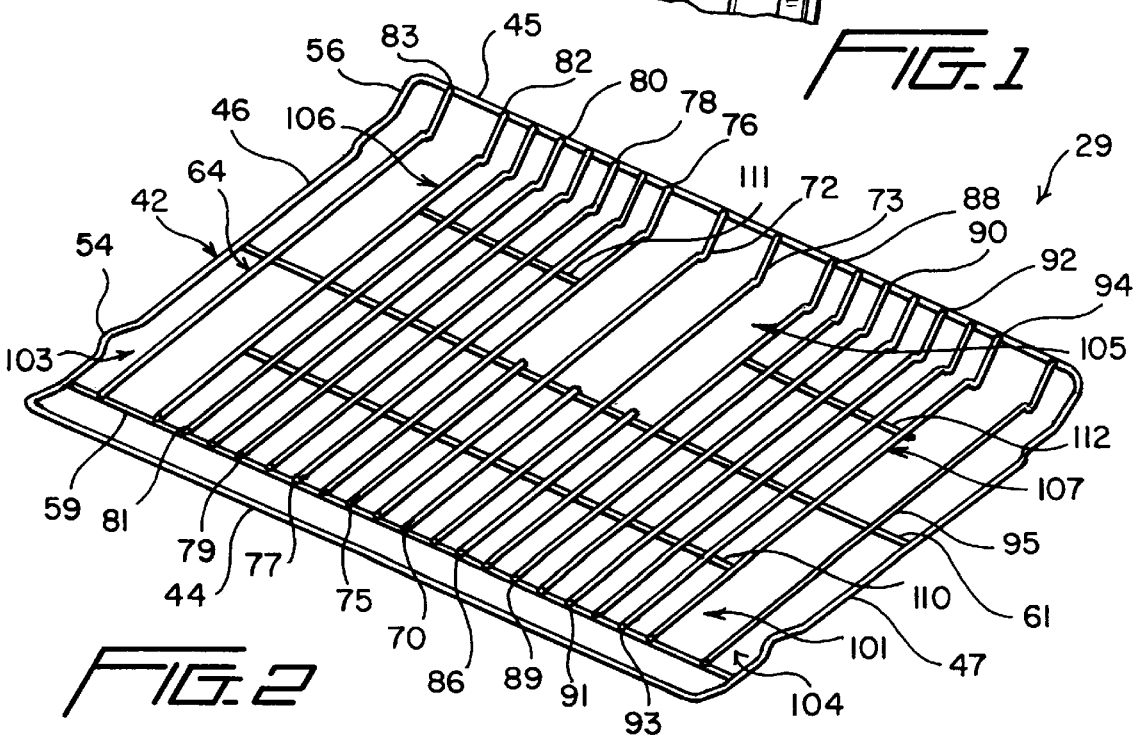
FIG. 2 is an upper right perspective view of the oven rack of FIG. 1.

In a manner also known in the art, rails 21 preferably include downwardly projecting portions 32 which function, in combination with structure on rack 29, to limit the movement of rack 29 relative to oven cavity 5. As the manner in which rack 29 is supported for movement relative to oven cavity 5 is widely known in the art and not considered part of the present invention, it will not be discussed further herein. Instead, the present invention is directed to the configuration of rack 29 as will be detailed below with particular reference to FIG. 2.

In the preferred embodiment shown, oven rack 29 has a wire construction and includes a frame 42 defined by front, rear and side rods 44–47. Preferably, frame 42 is formed from bending a single metal bar to form the front, rear and side rods 44–47. Each side rod 46, 47 is preferably formed with an upstanding section 54 spaced rearward of front rod 44, as well as an upwardly sloping section 56 leading to rear rod 45. Actually, side rods 46 and 47 also preferably slope slightly upward at front rod 44. Upstanding sections 54 and sloping sections 56 are adapted to cooperate with the downwardly projecting portions 32 of rails 21 to limit the degree of travel of oven rack 29 into and out of oven cavity 5. In general, this interaction between oven rack 29 and oven cavity 5 is common in the art and not considered part of the present invention so that a further discussion thereof will not be made here.

Frame 42 is also preferably provided with a front, laterally extending cross rod 59 which is affixed, such as by welding, to side rods 46 and 47 at a position spaced slightly rearward of front rod 44. As shown, front cross rod 59 extends generally parallel to front rod 44. Due to the spacing provided, front rod 44 can be conveniently used as a handle for oven rack 29. Frame 42 is also provided with a substantially central cross rod 61 which also extends laterally and is affixed to side rods 46 and 47.

In addition to frame 42, oven rack 29 includes a support platform 64. In accordance with the most preferred form of the invention, support platform 64 is constituted by a plurality of support elements in the form of elongated and shorter wires. More specifically, support platform 64 includes a central, short wire 70 which extends fore-to-aft within frame 42, with wire 70 having terminal ends (not separately labeled) affixed to cross rods 59 and 61. On either lateral side of central wire 70, support platform 64 is generally symmetrical. That is, on either side of central wire 70 is provided a pair of elongated, substantially central wires 72 and 73 which extend from front cross rod 59 to rear rod 47, while also being affixed to central cross rod 61. Adjacent elongated wire 72 is a short wire 75 that extends only between front cross rod 59 and central cross rod 61. Thereafter, leading to side rod 46 is a plurality of elongated wires 76–83 which, in a manner directly corresponding to elongated wires 72 and 73, are affixed to cross rods 59 and 61, as well as rear rod 45. Again, support platform 64 is preferably symmetrical on either side of central wire 70. Therefore, adjacent elongated wire 73 is arranged a short wire 86, followed by a plurality of elongated wires 88–95.

In general, wires 70, 72, 73, 75–83, 86 and 88–95 extend parallel to each other in the fore-to-aft direction within frame 42. With this configuration for support platform 64, oven rack 29 defines primary and secondary food item support zones, with the various wires being arranged in closer proximity within the primary zones. More specifically, oven rack 29 is divided into a frontal section, defined between front cross rod 59 and central cross rod 61, and a rear or aft section defined between central cross rod 61 and rear rod 45. Within the frontal section, a single primary support zone 101 is defined from wire 82 to wire 94. Laterally outwardly of primary support zone 101 is respective secondary support zones 103 and 104. Secondary support zones 103 and 104 extend fore-to-aft into both the frontal section and the aft section. Within the aft section of oven rack 29, a secondary support zone 105 is interposed between primary support zones 106 and 107. That is, secondary support zone 105 is defined laterally between elongated wires 76 and 88, while primary support zones 106 and 107 are defined by wires 76–82 and 88–94 within the aft section.

The construction of oven rack 29 as described above with the inclusion of the primary and secondary support zones, with the primary zones being defined by support elements which are arranged in closer proximity, directs a consumer to position food items to be cooked within oven cavity 5 in the primary zones when possible. In the most preferred form of the invention shown in the drawings, the wires in the secondary support zones 103–105 are spaced approximately twice the distance of the wires in primary support zones 101, 106 and 107. In accordance with the invention, it is desired to have the support elements in secondary support zones 103–105 spaced at least a one and one-half times the spacing of the support elements in primary zones 101, 106 and 107.

The varying spacing feature of the invention is considered particularly advantageous when cooking appliance2 constitutes an electric oven having a heating element that is used to toast bread or the like. That is, the oven rack 29 of the invention is constructed so as to locate the primary zones substantially directly above respective portions of the heating element. When the bread is placed in these optimally located zones, it has been found that an enhanced toasting operation can be performed. Since the food items are intended to be supported in primary zones 101, 106 and 107, oven rack 29 also preferably incorporates a plurality of cross wires 110–112 for respectively interconnecting wires 70, 72, 73, 75–82, 86 and 88–94 in primary zone 101, wires 76–82 in primary zone 106 and wires 88–94 in primary zone 107.

Although described with reference to a preferred embodiment of the invention, it should be readily understood that various changes and/or modifications could be made without departing from the spirit of the invention. For instance, although rods and wires are provided to define the frame and support platform, other types of support elements could be also utilized. In addition, the particular locations for the primary and secondary support zones could vary in accordance with the invention, particularly depending on the exact configuration and mounting to the heat source for oven cavity 5. In any event, the invention is only intended to be limited by the scope of the following claims.

We claim:

1. An oven rack for supporting food items to be cooked in a cavity of an appliance comprising:

a frame portion and a support platform, said support platform including a frontal section, an aft section and a plurality of spaced support elements defining primary and secondary zones upon which food items to be cooked are to be placed, wherein the support elements are in closer proximity within the primary zones than in the secondary zones, the aft section includes first and second primary zones and a first secondary zone, and the first secondary zone is interposed between the first and second primary zones.

2. The oven rack according to claim 1, wherein the first secondary zone is centrally located within the aft section.

3. The oven rack according to claim 2, further comprising:

second and third secondary zones located laterally outwardly of the first and second primary zones respectively.

4. The oven rack according to claim 1, wherein the frontal section includes a third primary zone which laterally spans a distance substantially equal to the first and second primary zones and the first secondary zone.

5. The oven rack according to claim 4, further comprising:

additional secondary zones located laterally outwardly of the primary zones in each of the frontal and aft sections.

6. The oven rack according to claim 1, wherein the frame portion includes front, rear and side rods, said support elements being constituted by spaced wires.

7. An oven rack for supporting food items to be cooked in a cavity of an appliance comprising:

a frame portion, including front, rear and side rods, and a support platform, sad support platform including a plurality of spaced support elements which are constituted by spaced wires and define primary and secondary zones upon which food items to be cooked are to be placed, wherein the support elements are in closer proximity within the primary zones than in the secondary zones and wherein the wires extend fore-to-aft and terminate at a position spaced from the front rod.

8. The oven rack according to claim 7, wherein the support platform includes a frontal section and an aft section, with at least the aft section defining both primary and secondary zones.

9. The oven rack according to claim 8, wherein the aft section includes first and second primary zones and a first secondary zone, wherein the first secondary zone is interposed between the first and second primary zones.

10. The oven rack according to claim 6, wherein the wires are laterally spaced by a first distance in the primary zones and the wires defining the secondary zones are spaced from the wires defining the primary zones by a second distance which is at least one and one-half times the first distance.

11. The oven rack according to claim 9, wherein the frontal section includes a third primary zone which laterally spans a distance substantially equal to the first and second primary zones and the first secondary zone.

12. The oven rack according to claim 11, further comprising:

additional secondary zones located laterally outwardly of the primary zones in each of the frontal and aft sections.

13. The oven rack according to claim 7, further comprising:

at least one cross rod extending between said side rods at a position spaced slightly rearward of said front rod, said support elements extending from said rear rod toward said front rod.

14. An oven rack for supporting food items to be cooked in a cavity of an appliance comprising:

a frame portion, including front, rear and side rods, and a support platform, support platform including a plurality of spaced support elements which are constituted by spaced wires and define primary and secondary zones upon which food items to be cooked are to be placed, wherein the support elements are in closer proximity within the primary zones than in the secondary zones, said oven rack further including at least one main cross bar extending between said side rods and a cross wire extending laterally across the support elements in one of the primary zones, with the cross wire terminating short of the side rods.

15. The oven rack according to claim 14, further comprising:

at least one cross wire interconnecting the support elements in each of the primary zones.

16. An oven rack for supporting food items to be cooked in a cavity of a cooking appliance including at least one heating element comprising:

a frame portion and a support platform, said support platform including a plurality of spaced support elements defining multiple primary zones and at least one secondary zone upon which food items to be cooked can be placed, said support elements being in closer proximity within the primary zones than in the secondary zones, wherein said primary zones are adapted to be located directly adjacent predetermined portions of the at least one heating element during operation of the cooking appliance and the proximity of the support elements within the primary zones guides placement of food items for alignment with the predetermined portions of the at least one heating element.

17. The oven rack according to claim 16, wherein the support platform includes a frontal section and an aft section, with at least the aft section defining both primary and secondary zones.

18. The oven rack according to claim 17, wherein the aft section includes first and second primary zones and a first secondary zone, wherein the first secondary zone is interposed between the first and second primary zones.

19. The oven rack according to claim 18, wherein the frontal section includes a third primary zone which laterally spans a distance substantially equal to the first and second primary zones and the first secondary zone.

20. The oven rack according to claim 19, further comprising:

additional secondary zones located laterally outwardly of the primary zones in each of the frontal and aft section.

* * * * *